US007127909B1

(12) United States Patent
Brooks

(10) Patent No.: US 7,127,909 B1
(45) Date of Patent: Oct. 31, 2006

(54) CRUSHED ICE EXTRUDER

(75) Inventor: Charles A. Brooks, North Little Rock, AR (US)

(73) Assignee: Chrystal L. Brooks Irrevocable Trust, Tulsa, OK (US)

( * ) Notice: Subject to any disclaimer, the term of this patent is extended or adjusted under 35 U.S.C. 154(b) by 499 days.

(21) Appl. No.: 10/743,659

(22) Filed: Dec. 22, 2003

(51) Int. Cl.
*F25C 1/14* (2006.01)

(52) U.S. Cl. ..... 62/354

(58) Field of Classification Search ..... 62/354; 264/117–118, 141–143; 425/206–208, 380, 425/464

See application file for complete search history.

(56) References Cited

U.S. PATENT DOCUMENTS 3,196,624 A * 7/1965 Reynolds ..... 62/71
4,429,551 A 2/1984 Hizume
4,467,622 A 8/1984 Takahashi et al.
4,741,173 A 5/1988 Neumann
5,109,679 A 5/1992 Hida
5,123,260 A * 6/1992 Althoff et al. ..... 62/354
5,197,300 A 3/1993 Sakamoto et al.
5,460,014 A 10/1995 Wang
5,911,749 A 6/1999 Sugie

* cited by examiner

*Primary Examiner*—William E. Tapolcai
(74) *Attorney, Agent, or Firm*—Head, Johnson & Kachigian

(57) ABSTRACT

An extrusion head where continuous formation of crushed ice has uniquely shaped externally protruding bosses that break ice into uniformly shaped pieces. The extrusion head has no moving parts and is easily retrofitted onto existing screw-type continuous crushed ice making machines.

6 Claims, 5 Drawing Sheets

CRUSHED ICE EXTRUDER

BACKGROUND OF THE INVENTION

1. Field of the Invention

The present invention relates to a modified extrusion head for use in a crushed ice machine. It includes modified bosses that break rods of ice into smaller pieces of a pre-determined size. Large and small bosses are shaped differently so as to break ice rods up into chunks. The larger bosses flange outward at the top of the extrusion head while the smaller bosses do not extend to the top of the head.

2. Prior Art

Crushed ice is a highly desired commodity especially in the restaurant and convenient store businesses. Large volumes of ice are used daily by both of these industries as well as others. As a result, many different designs have been developed for crushed ice making machines capable of forming crushed ice rapidly and continuously.

U.S. Pat. No. 4,429,551, issued on Feb. 7, 1984 to Hizume discloses an extrusion head for an auger type icemaker whose bosses extend downward over the topmost portion of the auger. The design is intended to prevent choking of crushed ice that is pushed up over the top of the extrusion head. It contemplates the use of standard methods for breaking the ice down into smaller pieces. It does not contemplate modifying the upper end of the bosses to break up the ice without use of additional structural features.

U.S. Pat. No. 4,467,622, issued on Aug. 28, 1984 to Takahashi et al. discloses an extrusion head specifically designed to form shaved ice of superior quality. The channels of the extrusion head formed by its bosses each contain a small slit or channel that allows air to escape from the ice. This prevents excessive cooling of the ice and forms harder shaved ice particles. This patent also contemplates the use of a standard method of breaking the ice bars into shaved ice chips. It does not suggest that changing the shape of the upward end of the bosses may improve the breaking of the ice bars into crushed ice.

U.S. Pat. No. 4,741,173, issued on May 3, 1988 to Neumann discloses an extrusion head having modified fins or bosses designed to prevent the ice column from rotating within the extrusion apparatus. As with the above two patents, it contemplates the use of an angled surface to impinge upon emerging ice bars to break up the ice. While the angled surface shown in this patent is intended to rotate, the mechanism operates in the same manner. It does not suggest the modifications made in the present invention.

U.S. Pat. No. 5,109,679 issued on May 5, 1992 to Hida discloses an auger type ice making machine having multiple blades above the extrusion head for breaking the ice rods into shaved ice pieces. The blades are adjustable so that the size of the shaved ice pieces may be readily adjusted. While this patent does illustrate a new, alternative method of breaking the ice rods into pieces of ice, its method is vastly different than that of the present invention. As with other ice breaking devices, the blades rotate at the same speed as the auger and the size of the ice pieces is adjusted by adjusting the distance between the blades. It does not suggest that modifying the bosses about the extrusion head could create an alternative method of breaking the ice rods.

U.S. Pat. No. 5,197,300 issued on Mar. 30, 1993 to Sakamoto et al. discloses an auger type ice making machine. The patent is apparently developed by Hoshizaki, one of the manufacturers you named for us. The device disclosed in this patent has an extrusion head that bobs, or oscillates, in an up and down motion. It is intended to convey some of the load applied to the extrusion head by the auger to a cam device located above the extrusion head. As with much of the prior art, it contemplates only the use of an annular flange to break the ice rods into smaller pieces of ice.

U.S. Pat. No. 5,460,014 issued on Oct. 24, 1995 to Wang discloses an auger type ice making machine that has a unique auger-within-an-auger design. As with the other patents uncovered in the search, this patent only contemplates the use of an annular flange to break apart the ice rods. The novelty of this patent lies in increasing the efficiency of heat transfer from the water to the FREON coolant.

U.S. Pat. No. 5,911,749 issued on Jun. 15, 1999 to Sugie discloses an auger-type ice maker. This patent is also owned by the Hoshizaki company. The patent discloses a specially designed boss for the formation of ice forming channels about the extrusion head. The lower end of the boss is curved in such a way as to prevent over compression of the ice. This reduces the back load on the auger, thereby increasing efficiency of the machine. It does not disclose any novel methods of breaking the ice rods or ice bars into smaller pieces of ice.

The extrusion head shown in the above patents all divide a tubular sheet of ice into a series of ice rods that are then broken up into smaller pieces of ice by various devices above the extrusion head. Some of these devices are complicated and require multiple moving parts. Other devices are stationary but do not break the ice rods into uniform pieces of crushed ice. Relatively long pieces of the ice rods may remain in tact. This results in an inferior crushed ice product.

It is therefore desirable to provide means of continuously producing crushed ice having a minimum number of moving parts.

It is also desirable to provide a method of continuously producing crushed ice in which the crushed ice pieces are uniform in size.

SUMMARY OF THE INVENTION

The present invention provides a modified crushed ice extrusion head for a screw-type crushed ice machine. Existing ice machines may be easily retrofitted with the improved extrusion head. The extrusion head is cylindrical and has a series of externally protruding longitudinal bosses. The bosses alternate between wide bosses and narrow bosses. The wide bosses flange out to each side at the top portion of the extrusion head. The narrower bosses do not extend the entire length of the extrusion head cylinder. The short and narrow bosses work with the flanged portion of the wide bosses to bend the ice rods such that the break into pieces of a uniform size.

It is also possible for the bosses to all be of equal size so long as the upward ends have the proper configuration. The channels through which the ice rods are pushed has a bottom created by a cylindrical body of the extrusion head. Two walls are created by the bosses on either side of the channels. On one side of the upper end of the channel, the boss does not extend all the way to the top of the cylindrical body of the extrusion head. On the other side of the channel, the boss flanges slightly inward into the channel. It is the flange on one side of the channel combined with a shortened wall on the other side of the channel that causes the ice rod to break. The resulting ice pieces have a width equivalent to the width of the channel, a depth equivalent to the depth of the channel which is equivalent to the distance the bosses protrude from the cylindrical body of the extrusion head and have a length equivalent to the distance from the top of the extrusion head to the end of the shortened boss.

It is therefore an object of the present invention to provide a crushed ice extrusion head that does not have any moving parts and separates ice rods into uniformly shaped pieces of crushed ice.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

The extrusion head of the present invention is very similar to those of the prior art. Some of the significant differences lie in the design of the bosses that form the channels through which ice is forced by the auger below the extrusion head. These modified bosses automatically break up the ice rods formed in the channels. While the prior art produces crushed or flake ice of various sizes, the present invention efficiently breaks the ice rods into uniformly shaped pieces that are the same size. No moving parts are required to accomplish this. In addition, the preferred embodiment creates only a minimal and insubstantial amount of back pressure.

In one embodiment alternating wide and narrow bosses protrude from the cylindrical body of the extrusion head. Those skilled in the art will appreciate that this is a common design among crushed and flaked ice extrusion heads. The larger bosses extend the entire length of the cylinder while the smaller bosses extend up to the top of the cylinder but begin with a pointed edge slightly above the bottom of the cylinder. In the present invention the smaller bosses do not extend to the top of the cylinder. In addition, the wide bosses flange outwardly at the top most end.

Figure 1:
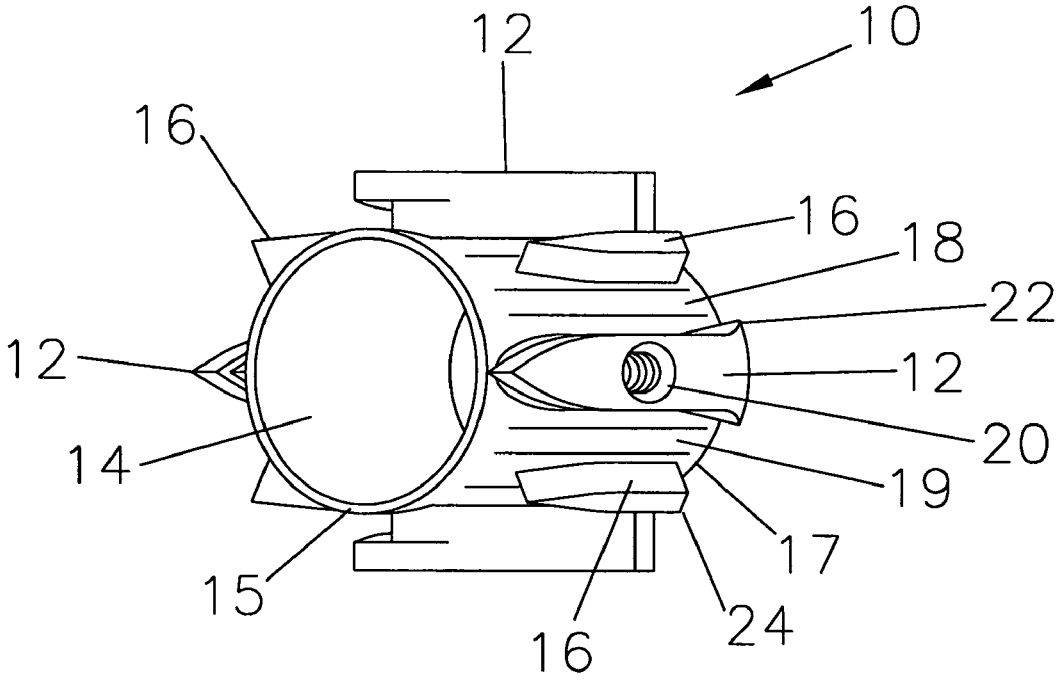
FIG. 1 shows a perspective view of the preferred embodiment of the present invention.

FIG. 1 shows a preferred embodiment of the present invention. Extrusion head 10 is comprised of a cylinder 14 that has a bottom 15 and a top 17. Running longitudinally along the cylinder are wide bosses 12 and narrow bosses 16. These form channels 18 and 19 through which rods of ice pass. The ends 24 of narrow bosses 16 do not extend to the top of the cylinder 17. The ends 22 of wide bosses 12 flange outward slightly. Wide bosses 12 also have attachment hole 20 into which a bolt is inserted to hold the extrusion head in place in the crushed ice making machine. In this embodiment, ends 22 of bosses 12 flange outwardly in a gentle, curved manner. This slight curving prevents any significant back pressure on ice rods as they move through channels 18 and 19.

Channels 18 and 19 are mirror images of one another. As can be seen, the boss 12 on the left side of channel 19 flanges in a manner such that it protrudes slightly into the left side of the top of channel 19. Because it is shortened, the right wall formed by boss 16 of channel 19 comes to an end before the left side formed by boss 12. Channel 18 has a symmetric, mirror image design of channel 19. In channel 18, the right side of the channel is formed by boss 12 that encroaches slightly upon channel 18 at the top of the extrusion head. Similarly, shortened boss 16 means that the left wall of channel 18 ends prematurely. Those skilled in the art will appreciate that regardless of which side of the channel encroaches slightly into the channel at the top of the extrusion head and which side of the channel ends prematurely is immaterial so long as there is one of each. Those skilled in the art will appreciate that the invention will not work if both sides of the channel encroach upon the inside of the channel, such as top end 22 of boss 12. In fact, such a design would cause back pressure and would be ineffective and undesirable. If both sides of the channel are shortened such as bosses 16, they will have substantially no effect on the ice rods and they will extend out of the extrusion head without having been broken into smaller pieces. Those skilled in the art will also appreciate that it makes no difference whether it is wide or narrow bosses that make up the various sides of the channels. For example, it is equally effective to have the wide bosses shortened so that they do not extend to the top end of the cylindrical body of the extrusion head while the narrow bosses extend all the way to the top of the extrusion head and flange outwardly so that they encroach upon the respective channels.

Figure 2:
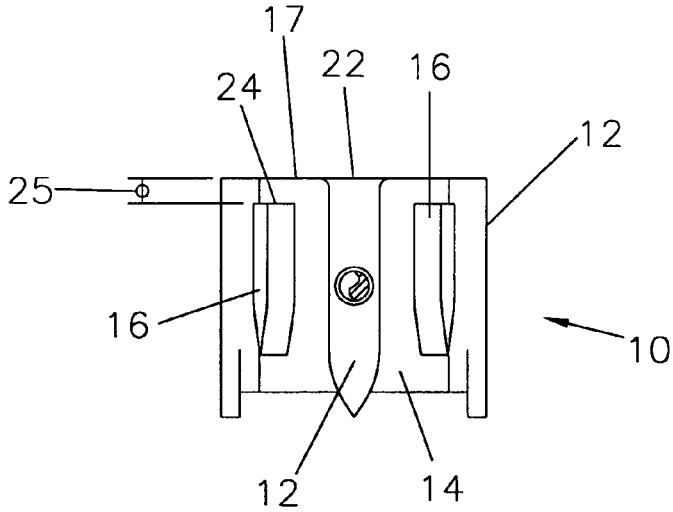
FIG. 2 shows a side view of the preferred embodiment of the present invention.

FIG. 2 shows a side view of extrusion head 10. The outwardly flanging end of wide bosses 12 can be seen. Ends 24 of narrow bosses 16 can also be seen to not extend to the top 17 of cylinder 14. The distance 25 between the ends 24 of narrow boss 16 and the top of cylinder 17 determines the size of the crushed or flaked ice pieces.

Figure 3:
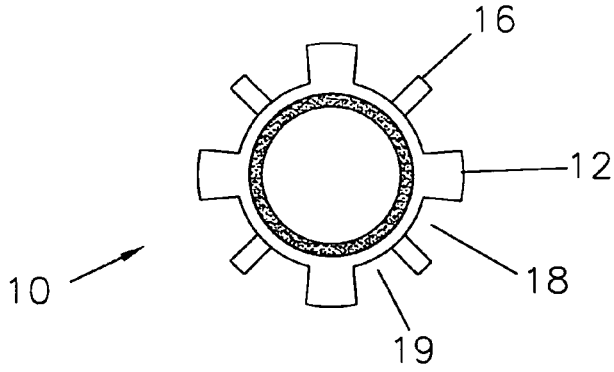
FIG. 3 shows a top plan view of the embodiment of FIG. 1.
Figure 4:
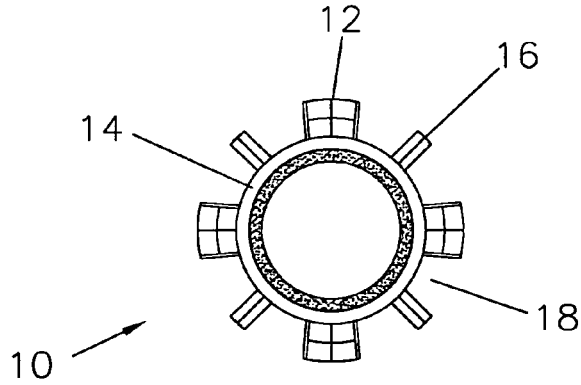
FIG. 4 shows a bottom plan view of the embodiment of FIG. 1.

FIGS. 3 and 4 show a top down and bottom up view of the extrusion head respectively. In this particular embodiment, there are four wide bosses 12 and four narrow bosses 16 that alternate around the exterior cylinder 14. This results in eight channels 18 and 19. Those skilled in the art will appreciate that more or less channels may be formed by changing the number of bosses. With the design of this embodiment, any number of channels may be formed so long as narrow bosses 16 and wide bosses 12 alternate.

Figure 5:
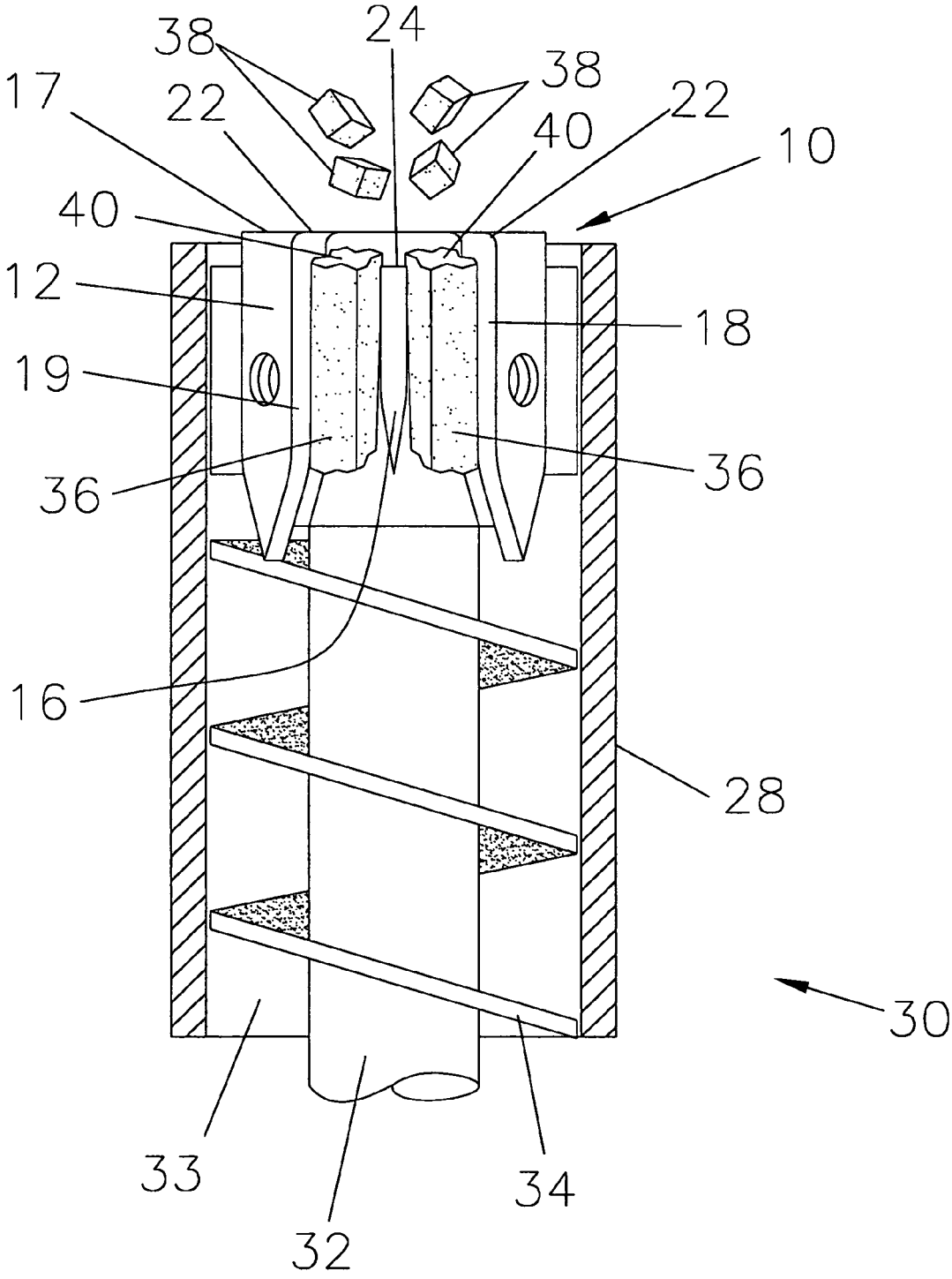
FIG. 5 shows an environmental view of the embodiment of FIG. 1.

FIG. 5 shows the extrusion head of the present invention in use in a crushed or flaked ice making machine. Those skilled in the art will appreciate that this is a typical screw or auger-type ice making machine. Extrusion head 10 rests above and on top of auger 32. Sleeve 28 fits snugly around extrusion head 10 and auger 32. Water is fed into ice making chamber 33. Sleeve 28 is surrounded by a cooling device (not shown). Auger 32 turns, and as ice is formed within chamber 33, thread 34 pushes it upward into the channels of the extrusion head. The ice forms ice rods 36. As the top of ice rods 40 come into contact with the flanged tops 22 of wide bosses 12, they are broken up into crushed or flaked ice pieces 38. Ice pieces 38 are approximately as wide as the channels 18 and 19 and as long as the distance between the end 24 of narrow bosses 16 and the top of the extrusion head 17. No substantial back pressure is created by this design. Furthermore, extended rods of ice do not escape from the extrusion head and all are divided up into crushed ice of a uniform size. The size of the crushed or flaked ice pieces can be changed by changing the distance between end 24 of narrow bosses 16 and the top of the extrusion head 17. As will be understood by those skilled in the art, the extrusion head of the present invention may readily be inserted into existing crushed ice machines. Such retrofitted machines will have fewer parts that must be maintained, cleaned and replaced.

Figure 6:
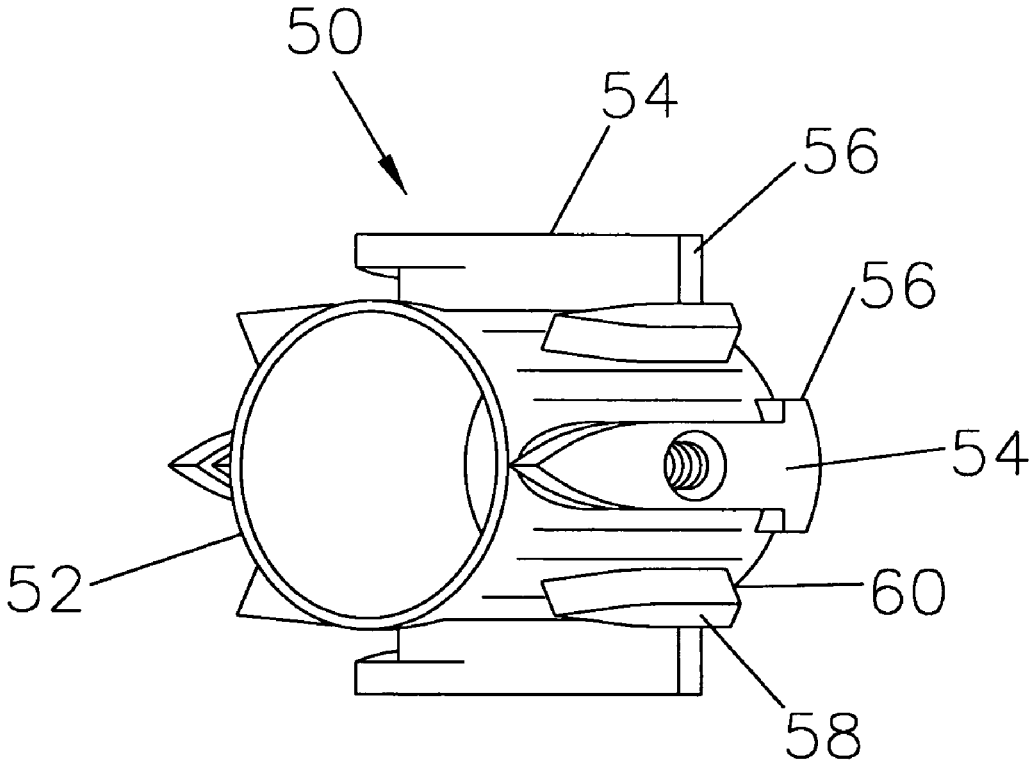
FIG. 6 shows an alternative embodiment of the present invention.

FIG. 6 is an alternative embodiment of the present invention. Extrusion head 50 is comprised of a cylinder 52 having wide bosses 54 and narrow bosses 58. Narrow bosses 58 are substantially similar to those of the embodiment described in FIGS. 1 through 5. End 60 does not go all the way to the top of the cylinder 52. Extrusion head 50 differs from that disclosed in FIGS. 1 through 5 having tops 56 of wide bosses 54. Tops 56 flange outwardly but in an angular, rather than curved fashion. This achieves the same effect as the design disclosed in FIGS. 1 through 5.

Generally, however, extrusion head 10 is preferred over extrusion head 50. The angular nature of the ends 56 of bosses 54 tends to create slightly more back pressure than the curved flanged ends of extrusion head 10. Furthermore, ends 56 have more pressure exerted upon them by emerging ice rods and are therefore subject to more and faster wear. Extrusion head 50 is intended to show that the flanging portion of the wide bosses does not specifically have to be curved. As long as the tops of the wide bosses encroach or extend into the channels to an extent and the narrow bosses do not extend all the way to the top of the extrusion head, crushed ice is sufficiently and uniformly formed.

Figure 7:
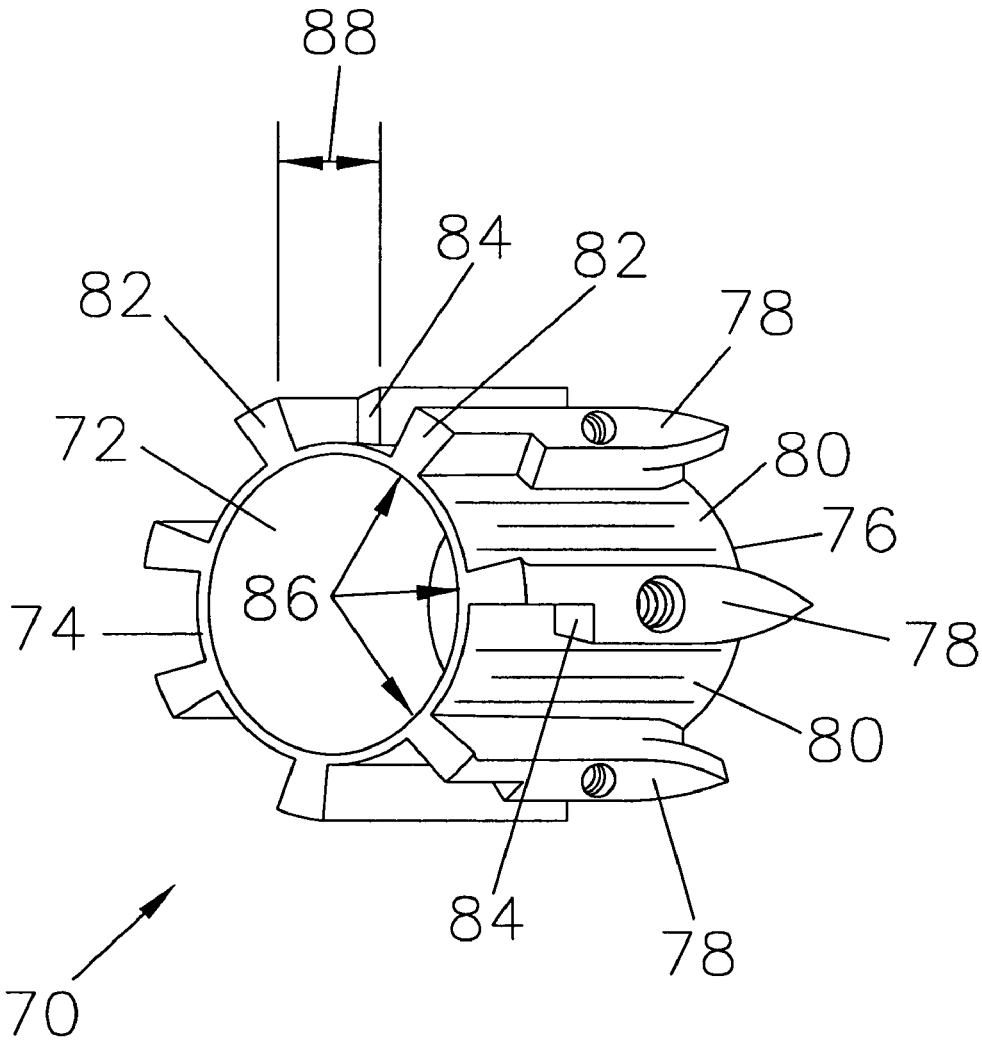
FIG. 7 shows an alternative embodiment of the present invention.

FIG. 7 shows another alternative embodiment of the present invention. Extrusion head 70 consists of a cylindrical extrusion head body 72 having a top 74 and a bottom 76. In this embodiment, bosses 78 have an asymmetric design. In the embodiment shown in FIGS. 1 through 6, the bosses are designed to create symmetric, mirror image channels. An even number of bosses are required for this design. The design of FIG. 7 allows either an odd or even number of bosses to be utilized. This increases the number of types of crushed or flaked ice machines that may be retrofitted with the present invention.

Bosses 78 have a modified top end 86. Top ends 86 are comprised of two parts, flanged portion 82 and shortened portion 84. The bosses form several channels 80. There are as many channels 80 as there are bosses 78. At the top end of channels 80, the right side of the channel ends early as shortened end 84 of the boss does not extend all the way to the top 74 of the extrusion head. On the other side of the channel, flanged portion 82 partially encroaches into channel 80. Those skilled in the art will appreciate that this has the same effect as the alternating bosses shown in FIGS. 1 through 6. This embodiment illustrates how one of the key aspects of the invention is the asymmetry of the channels. At the upper portion of the extrusion head, one side of the channel ends before reaching the top of the extrusion head while the other side of the channel encroaches slightly at the top of the extrusion head. The pieces of ice formed have a depth equal to the distance which the bosses extend from the cylinder 72, a width equal to the width of the channels 80 and a length equal to the distance between the point at which boss end portion 84 ends and the end of the extrusion head 74. The latter distance is shown as distance 88.

Whereas, the present invention has been described in relation to the drawings attached hereto, it should be understood that other and further modifications, apart from those shown or suggested herein, may be made within the spirit and scope of this invention.

What is claimed is:

1. An extrusion head for a crushed ice making machine comprising:

a cylindrical body having a top and a bottom;

a plurality of bosses protruding outwardly and extending longitudinally along the body thereby forming a series of channels having two walls formed by the bosses;

wherein one wall of the channel does not extend to the top of the body and wherein the second wall extends to the top of the body and extends partially into the channel at the top of the body.

2. The extrusion head of claim 1 wherein the plurality of bosses comprises eight bosses.

3. The extrusion head of claim 2 wherein the eight bosses comprise alternative wide and narrow bosses.

4. The extrusion head of claim 1 wherein the plurality of bosses comprises an odd number of bosses.

5. The extrusion head of claim 1 wherein the second wall extends into the channel in a curved manner.

6. The extrusion head of claim 1 wherein the second wall of the channel extends into the channel in an angular manner.

* * * * *